US007034443B2

(12) United States Patent
Ahn et al.

(10) Patent No.: US 7,034,443 B2
(45) Date of Patent: Apr. 25, 2006

(54) PLASMA DISPLAY PANEL

(75) Inventors: Young Joon Ahn, Kyoungsangbuk-do (KR); Joong Kyun Kim, Seoul (KR); Bong Koo Kang, Kyoungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/378,939

(22) Filed: Mar. 5, 2003

(65) Prior Publication Data

US 2003/0168979 A1 Sep. 11, 2003

(30) Foreign Application Priority Data

Mar. 6, 2002 (KR) ..... 10-2002-0011998
Feb. 20, 2003 (KR) ..... 10-2003-0010714

(51) Int. Cl.
*H01J 17/49* (2006.01)

(52) U.S. Cl. ..... 313/292; 313/243; 313/582

(58) Field of Classification Search ..... 313/292, 313/243, 584–587; 315/169.4; 345/37, 345/41, 60

See application file for complete search history.

(56) References Cited

U.S. PATENT DOCUMENTS 5,701,056 A * 12/1997 Shinohara ..... 313/584
5,723,945 A * 3/1998 Schermerhorn ..... 313/581
6,479,935 B1 * 11/2002 Park et al. ..... 313/586

FOREIGN PATENT DOCUMENTS

JP 64-041139 A 2/1989
JP 08-203439 A 8/1996
JP 11-162362 A 6/1999
JP 2000-100336 A 4/2000
KR 2002-0000706 A 1/2002

* cited by examiner

*Primary Examiner*—Ashok Patel
(74) *Attorney, Agent, or Firm*—Birch Stewart Kolasch & Birch LLP

(57) ABSTRACT

A plasma display panel configuration helps to prevent unwanted discharge generation in cells adjacent to excited discharge cells and to improve picture quality of the plasma display panel. An exemplary embodiment of the present invention includes barrier ribs for partitioning off discharge cells, wherein edge parts of the cross sectional shape of the barrier ribs are lower than central parts of the cross sectional shape of the barrier ribs and can have a number of distinctive shapes.

21 Claims, 10 Drawing Sheets

166

PLASMA DISPLAY PANEL

BACKGROUND OF THE INVENTION

1. Field of the Invention

The present invention relates to a plasma display panel, and more particularly to a plasma display panel that is adaptive for preventing mis-discharge from being generated in adjacent cells in driving the PDP and for improving picture quality.

2. Description of the Related Art

Recently, there have been developed various flat display panels that can reduce their weight and bulk, which was the disadvantage of a cathode ray tube CRT. Such flat display panels include liquid crystal displays LCD, field emission displays FED, plasma display panels PDP, electro-luminescence EL display device and so on.

The PDP among these display devices takes advantage of gas discharge and has an advantage of being made into a large-dimensioned panel easily. A three-electrode AC surface discharge PDP is a typical PDP, which includes three electrodes as shown in FIG. 1 and is driven with AC voltage.

Referring to FIG. 1, a discharge cell of a three-electrode AC surface discharge PDP in the related art includes a first electrode 12Y and a second electrode 12Z formed on an upper substrate 10, and an address electrode 20X formed on a lower substrate 18.

The first and second electrodes 12Y and 12Z are formed of a transparent material in order to transmit the light supplied from the discharge cell. There are formed bus electrodes 13Y and 13Z of a metal material in parallel to and on the rear surface of the first and second electrodes 12Y and 12Z. Such bus electrodes 13Y and 13Z are used to supply driving signals to the first and second electrodes 12Y and 12Z that have high resistance.

There are formed an upper dielectric layer 14 and a passivation film 16 on the upper substrate 10 provided with the first and second electrodes 12Y and 12Z. On the upper dielectric layer 14, there are formed wall charges generated upon plasma discharge. The passivation film 16 prevents the damage of the upper dielectric layer 14 by the sputtering generated upon the plasma discharge, and at the same time, increase the emission efficiency of secondary electrons. The passivation film 16 is usually magnesium oxide MgO.

There are formed a lower dielectric layer 22 and barrier ribs 24 on the lower substrate 18 provided with the address electrode 20X, and the surface of the lower dielectric layer 22 and the barrier ribs 24 is coated with a phosphorus 26. The address electrode 20X is formed crossing the first and second electrode 12Y and 12Z. The barrier ribs 24 are formed parallel to the address electrode 20X to prevent an ultraviolet ray and a visible ray from leaking out to adjacent discharge cells, wherein the ultraviolet ray and the visible ray are generated by discharge.

The phosphorus 26 is excited by the ultraviolet ray generated upon the plasma discharge to generate any one of red, green and blue visible rays. There is injected an inert mixture gas such as He+Ne, He+Xe or He+Ne+Xe for the gas discharge in a discharge space provided between the upper/lower substrates and barrier ribs.

In the related art PDP, the first and second electrodes are formed opposite to each other in each discharge cell as in FIG. 2. The first electrode 12Y is supplied with reset pulses, scan pulses and first sustain pulses. The second electrode 12Z is supplied with second sustain pulses.

The discharge cells are initialized when the reset pulse is applied to the first electrode 12Y. The address electrode 20X is supplied with data pulses synchronized with the scan pulses when the scan pulses are applied to the first electrode 12Y. At this moment, there occur the address discharges in the discharge cells supplied with the scan pulses and the data pulses.

The first and second sustain pulses are alternately applied to the first and second electrodes 12Y and 12Z after the address discharges being generated in the discharge cells. If the first and second sustain pulses are applied to the first electrode 12Y and the second electrode 12Z, there is generated sustain discharges in the discharge cells where the address discharges were generated. The discharge time of the sustain discharge is determined by a gray level value, and accordingly a picture is displayed in accordance with gray level values.

On the other hand, in the related art PDP, the first and second electrodes 12Y and 12Z are formed opposite to each other with wide areas in each of the discharge cells. In this way, if the first and second electrodes 12Y and 12Z are wide in area, a lot of power is dissipated, and accordingly the discharge efficiency of the PDP is deteriorated. In order to overcome such a disadvantage, there has been suggested a PDP as in FIG. 3.

Referring to FIG. 3, a PDP according to another embodiment of the related art has a delta type structure where discharge cells located adjacent to each other on the upward/downward each make up one pixel. In other words, in the PDP according to the embodiment of the related art, an R sub-pixel and a B sub-pixel located in the $n^{th}$ (n is a natural number over 1) line and a G sub-pixel located in the $(n+1)^{th}$ or $(n-1)^{th}$ line make up one pixel.

The PDP according to the embodiment of the related art includes an address electrode 40X, a first and a second electrode 32Y, 32Z formed crossing the address electrode 40X, and a first and a second bus electrode 33Y, 33Z formed on the first and second electrodes 32Y and 32Z.

The first and second electrodes 32Y, 32Z include a first and a second main electrode 32A, 32C formed in a perpendicular direction to the address electrode 40X, and a first and a second auxiliary electrode 32B, 32D extended from the first and second main electrodes 32A, 32C in the same direction as the address electrode 40X.

The first auxiliary electrode 32B is formed on both sides of the first main electrode 32A, and the second auxiliary electrode 32D is formed on both sides of the second main electrode 32C in the same way as the first auxiliary electrode 32B.

The address electrode 40X includes an address main electrode 40A formed in a line crossing the first and second main electrodes 32A, 32C, and an address auxiliary electrode 40B extended by a designated width in a direction of crossing the address main electrode 40A within a discharge cell that makes up one pixel.

Further, on the upper surface of the POP according to another embodiment of the related art, there are the second auxiliary electrodes 32B alternately extended from the first main electrode 32A, and a first dielectric layer 44B that the upper dielectric layer and the protective film are sequentially deposited on the entire upper plate to cover the second auxiliary electrode 32B.

The wall charges generated upon the plasma discharge are accumulated through the upper dielectric layer on the first dielectric layer 44B, which prevents the damage of itself caused by the sputtering generated upon the plasma discharge by way of the passivation film and at the same time increases the emission efficiency of the secondary electrons.

On the lower surface of the PDP, there are formed a first to a third address electrode 42A, 42B, 42C crossing the first and second electrodes 32Y and 32Z, a second dielectric layer 44*a* on the entire lower plate to cover the address electrodes 42A, 42B, 42C, and horizontal barrier ribs 46B on the lower surface in the same direction as the first to third address electrodes 42A, 42B, 42C. There is formed a phosphorus (not shown) on the surface of the second dielectric layer 44A and the horizontal barrier ribs 46B. The first and third address electrodes 42A, 42C formed on both sides among the first to third address electrodes 42A, 42B, 42C are the address auxiliary electrode 40B extended from the address main electrode 40A to the direction of the first and second electrodes 32Y, 32Z, and the second address electrode 42B is the address electrode main electrode 40A. The barrier ribs 46B are formed parallel to the first to third address electrodes 42A, 42B, 42C to prevent the ultraviolet ray and the visible ray generated by the discharge from leaking out to the adjacent discharge cells.

In the PDP according to the embodiment of the related art, the upper part of the barrier ribs 46 has a rectangular shape.

FIGS. 5 to 12 are views representing equipotential surfaces when a specific voltage is applied to a discharge cell according to the POP shown in FIG. 4.

Referring to FIGS. 5 to 12, the width of the second auxiliary electrodes 32B formed on the upper plate of the PDP is 185 μm, the width of the first and second address electrodes 42A, 42C formed on both sides of the lower plate is 150 μm. 70 μm is the width of the second address electrode 42B, which is formed between the first and third address electrodes 42A, 42C and where the address auxiliary electrode 40B is not formed. 120 μm is the height of the horizontal barrier ribs 46B formed being closed on the lower plate, and the dielectric constant of the horizontal barrier ribs 46B is 12. At this moment, the second auxiliary electrodes 32B consist of a first-second auxiliary electrode 32B1 formed on its left on the basis of the horizontal barrier ribs 46B, and a second—second auxiliary electrode 32B2 formed on its right.

Further, in FIGS. 5 to 12, if the voltage applied is 0V, no voltage is applied, 1V means that a designated voltage is applied, and −1.2V means that a reverse voltage is applied and the absolute value of the voltage is higher than 1V.

Referring to FIGS. 5 to 7, the first-second auxiliary electrode 32B1 and the first and third address electrodes 42A and 42C of the PDP are supplied with 0V, i.e., no voltage is applied, and a voltage of 1V is applied only to the second address electrode 42B. At this moment, the discharge cell including the first and third address electrode 42A and 42C is a turned-off cell (hereinafter, off-cell), if such an off-cell is turned on, it is considered that there occurs mis-discharge.

Comparing FIG. 5 with FIG. 6, if the second address electrode 42B is supplied with a data voltage, the maximum electric field (the maximum electric field is formed between the upper part of the barrier ribs 66 and the first dielectric layer) of the off-cell including the first and third address electrodes 42A, 42C has a higher value in the event of FIG. 6 (Emax=1.55E-2) where an air gap exists between the horizontal barrier ribs 46B and the first dielectric layer 44B than in the event of FIG. 5 (Emax=8.8E-3) where an air gap does not exist. Hereby, there is a higher probability in mis-discharge in the event that there is the air gap between the horizontal barrier ribs 46B and the first dielectric layer 44B.

FIG. 7 represents the case that the air gap is big between the horizontal barrier ribs 46B and the first dielectric layer 44B. At this moment, the maximum electric field of the off-cell in FIG. 7 (Emax=1.48E-2) is not changed much when comparing with FIG. 6 (Emax=1.55E-2). In FIG. 7, the direction of the electric field is a perpendicular direction to the equipotential surfaces formed between the horizontal barrier ribs 46B and the first dielectric layer 44A. In this case, the electric field in the air gap (I) causes charged particles to move upward or downward in accordance with their polarity.

Referring to FIGS. 6 and 7, the first-second auxiliary electrode 32B1, the second-second auxiliary electrode 32B2 and the third address electrode 42C of the PDP are supplied with 0V, i.e., no voltage is applied, and a data voltage of 1V is applied to the first and second address electrodes 42A and 42B, FIG. 6 represents the case that there is no air gap between the horizontal barrier ribs 46B and the first dielectric layer 44B, and FIG. 7 represents the case that there is air gap between the horizontal barrier ribs 46B and the first dielectric layer 44B.

When comparing the strength of the maximum electric field induced to the off-cell including the third address electrode 42C in FIG. 6 with that in FIG. 7, as can be seen in FIGS. 3 and 4, the strength of the electric field is higher in FIG. 7, i.e., when there is air gap (Emax=1.48E-2), than when there is no air gap (Emax=8.85E-3).

Referring to FIGS. 8 and 9, the first-second auxiliary electrode 32B1, the second-second auxiliary electrode 32B2 and the third address electrode 42C of the PDP are supplied with 0V, i.e., no voltage is applied, and a data voltage of 1V is applied to the first and second address electrodes 42A and 42B. FIG. 8 represents equipotential surfaces when there is no air gap between the horizontal barrier ribs 46B and the first dielectric layer 44B, and about 9.02E-3 is the strength of the maximum electric field Emax induced to the off-cell that includes the third address electrode 42C. FIG. 9 represents equipotential surfaces when 25 μm is the air gap between the horizontal barrier ribs 46B and the first dielectric layer 44B, and about 1.52E-2 is the strength of the maximum electric field Emax induced to the off-cell that includes the third address electrode 42C.

Referring to FIG. 10, the first-second auxiliary electrode 32B1, the second-second auxiliary electrode 32B2 and the second and third address electrodes 42B, 42C of the PDP are supplied with 0V, i.e., no voltage is applied, and a data voltage of 1V is applied only to the first address electrode 42A. In this case, FIG. 10 represents equipotential surfaces when there is no air gap between the horizontal barrier ribs 46B and the first dielectric layer 44B, and about 9.4E-3 is the strength of the maximum electric field Emax induced to the off-cell that includes the third address electrode 42C.

As can be seen in FIGS. 5 to 9, the presence or absence of the air gap between the horizontal barrier ribs 46B and the first dielectric layer 44B is an important factor with respect to the mis-discharge. In other words, the strength of the maximum electric field is high when there is the air gap. Further, it can be seen through FIGS. 6 and 7 that the strength of the maximum electric field in the vicinity of the air gap is not much changed in accordance with the size of the air gap.

When observing though FIGS. 6, 7 and 9, cross talks occur because the voltage applied to the second address electrode 42B located at the lower part of the horizontal barrier ribs 46B forms a strong electric field in the vicinity of the air gap within the discharge cell if there is the air gap between the horizontal barrier ribs 46B and the first dielectric layer 44B. Comparing FIG. 8 with FIG. 10, there is generated no cross talk when 0V voltage is applied to the second address electrode 42B formed at the lower part of the horizontal barrier ribs 46B.

FIG. 11 represents equipotential surfaces when a specific voltage is applied to a discharge cell in accordance with the related art.

Referring to FIG. 11, the first-second auxiliary electrode 32B1, the second—second auxiliary electrode 32B2 of the POP are supplied with −1.2V voltage, the third address electrode 42C are supplied with 0V, and a data voltage of 1V is applied to the first and second address electrode 42A, 42B. In this case, the discharge cell including the first address electrode 42A is turned on (hereinafter, on-cell), and the cell including the third address electrode 42C is the off-cell because the data voltage is not applied. Further, FIG. 11 represents equipotential surfaces when 5 μm is the air gap between the horizontal barrier ribs 46B and the first dielectric layer 44B.

FIG. 12 is a diagram representing the relative strength of the electric field formed within the right and left discharge cells.

Referring to FIG. 12, the strength of the maximum electric field in the off-cell including the third address electrode 42C in the PDP appears to be almost the same as the strength of the maximum electric field of the discharge cells where the data voltage is applied to the first address electrode 42A when there is the air gap between the horizontal barrier ribs 46B and the first dielectric layer 44B as shown in FIG. 11, and the upper part of the horizontal barrier ribs 46B has a rectangular shape. In this case, there is a higher probability of the off-cell being turned on, i.e., a strong electric field is formed around the peripheral air gap due to the pulse applied to the column electrode of the peripheral off-cell to cause undesired discharge to be generated, thus a picture quality is deteriorated.

SUMMARY OF THE INVENTION

Accordingly, it is an object of the present invention to provide a plasma display panel that is adaptive for preventing mis-discharge from being generated in adjacent cells in driving the PDP.

It is another object of the present invention to provide a plasma display panel that is adaptive for reducing crosstalk.

In order to achieve these and other objects of the invention, a plasma display panel according to an aspect of the present invention includes a characteristic that edge parts of the barrier ribs are lower than central parts of the barrier ribs.

The discharge cells include red, green and blue discharge cells, being arranged in a delta shape.

The barrier ribs include first barrier ribs; and second barrier ribs coupled with the first barrier ribs vertically.

Herein, at least parts of the barrier ribs have their upper end rounded.

Herein, at least parts of the barrier ribs have their upper end edge stepped.

Herein, at least parts of the barrier ribs have a concave upper end edge.

The plasma display panel further includes a plurality of first electrodes formed on a first substrate, a plurality of second electrodes formed on a second substrate opposite to the first substrate with a discharge space therebetween to cross the first electrodes; a first dielectric layer formed on the first substrate to cover the first electrodes; a passivation film formed on the first dielectric layer; a second passivation layer formed on the second substrate to cover the second electrodes; and a phosphorus formed on the second dielectric layer and the barrier ribs.

The first electrode includes a metal bus electrode; and a transparent electrode connected to the metal bus electrode and having its width wider than the metal bus electrode.

The transparent electrode includes a main electrode; and an auxiliary electrode extended from the main electrode toward the discharge cell, and wherein the auxiliary electrode is extended from both sides of the main electrode in a zigzag.

The second electrode includes a main electrode; and an auxiliary electrode extended from both sides of the main electrode and having at least part thereof overlap the first electrode.

The barrier ribs are formed in a stripe shape, and central parts thereof are convex.

The barrier ribs are formed in a stripe shape, and an upper end edge thereof is stepped.

A plasma display panel according to another aspect of the present invention includes a characteristic that a dielectric constant value is different in parts of the barrier ribs.

Herein, edge parts of the barrier ribs are lower than central parts of the barrier ribs.

The barrier ribs include first barrier ribs; and second barrier ribs coupled with the first barrier ribs vertically.

Herein, any one of the first and second barrier ribs has a dielectric constant value of its lower end less than that of its upper end.

The dielectric constant value of the lower end of any one of the first and second barrier ribs is less than 12, and a dielectric constant value of an area except for the lower end is 12 or more.

A plasma display panel according to still another aspect of the present invention includes a characteristic that upper ends of the barrier ribs are opposite to the a substrate with an air gap therebetween, and the air gap between upper end edges of the barrier ribs and the first substrate is different from the air gap between central parts of the barrier ribs and the first substrate.

Herein, a dielectric constant value is different in parts of the barrier ribs.

Herein, edge parts of the barrier ribs are lower than central parts of the barrier ribs.

A plasma display panel according to still another aspect of the present invention includes a characteristic that upper ends of the barrier ribs are opposite to a first substrate with an air gap therebetween, a dielectric constant value is different in parts of the barrier ribs, and edge parts of the barrier ribs are lower than central parts of the barrier ribs.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

With reference to FIGS. 13 to 19C, embodiments of the present invention will be explained as follows.

Figure 1:
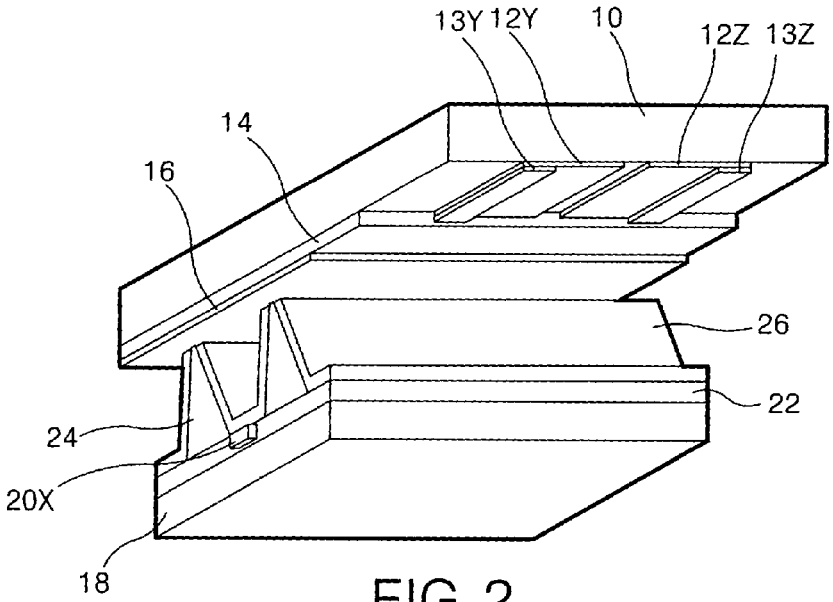
FIG.1 RELATED ART
FIG. 1 is a perspective view representing a three-electrode AC surface discharge plasma display panel in the related art.
Figure 2:
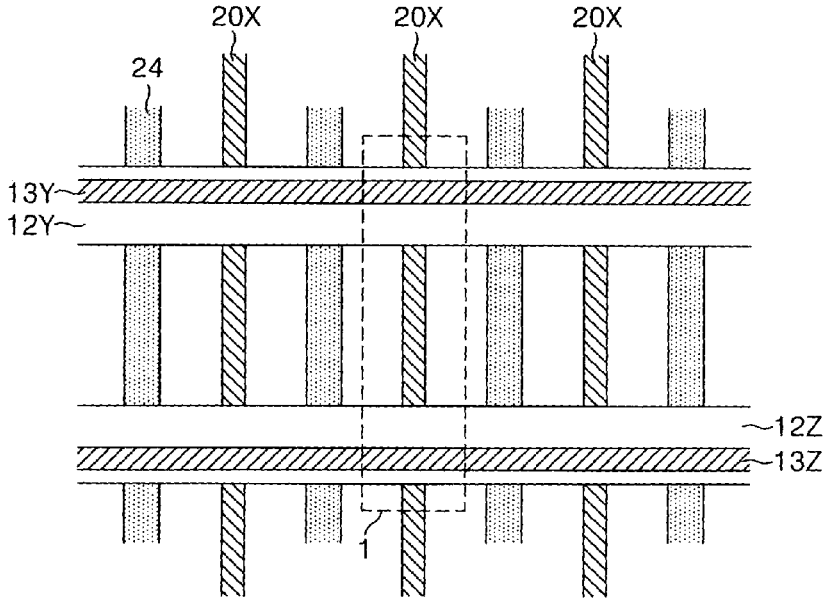
FIG.2 RELATED ART
FIG. 2 is a diagram representing an electrode structure of the PDP shown in FIG. 1.
Figure 3:
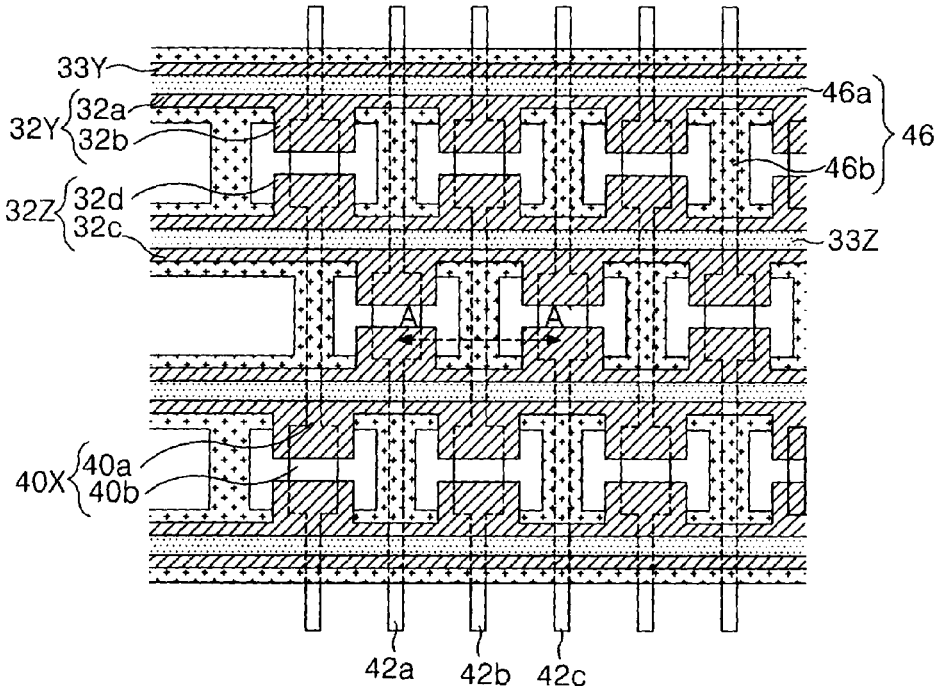
FIG.3 RELATED ART
FIG. 3 is a plan view representing an electrode structure of another PDP according to another embodiment in the related art.
Figure 4:
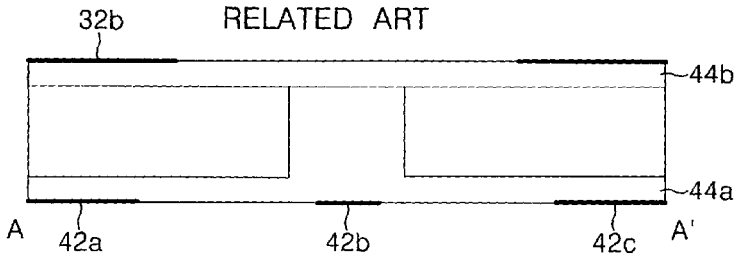
FIG.4 RELATED ART
FIG. 4 a sectional view of the PDP taken along the line "A–A'" of FIG. 3.
Figure 5:
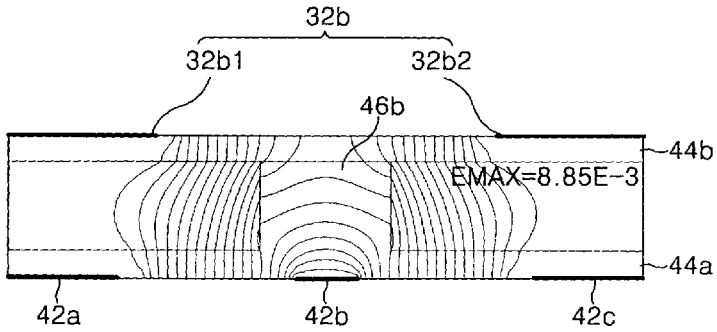
FIG.5 RELATED ART
FIGS. 5 to 11 are diagrams each representing equipotential surfaces when a specific voltage is applied to a discharge cell according to the related art.
Figure 6:
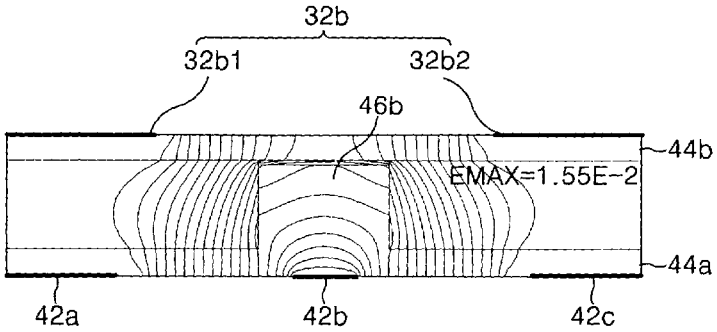
FIG.6 RELATED ART
Figure 7:
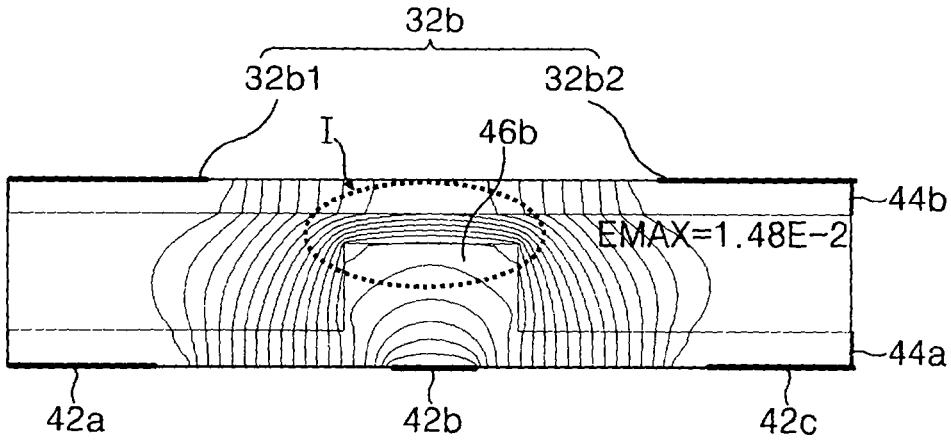
FIG. 7 RELATED ART
Figure 8:
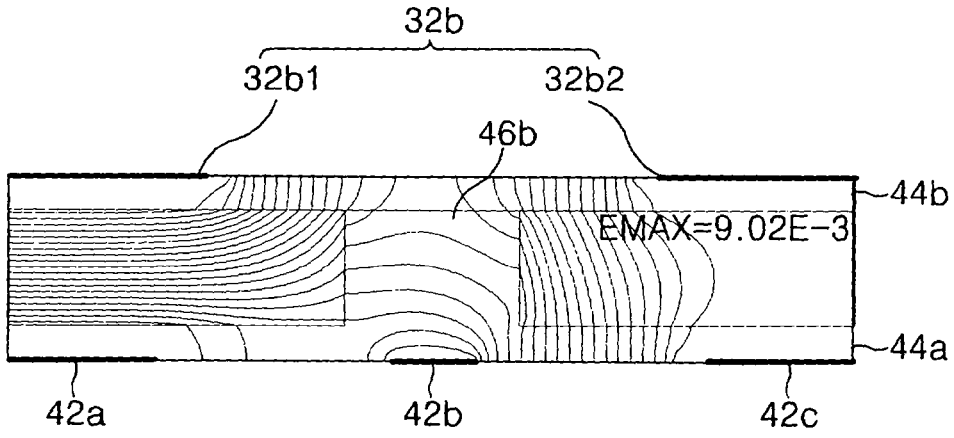
FIG. 8 RELATED ART
Figure 9:
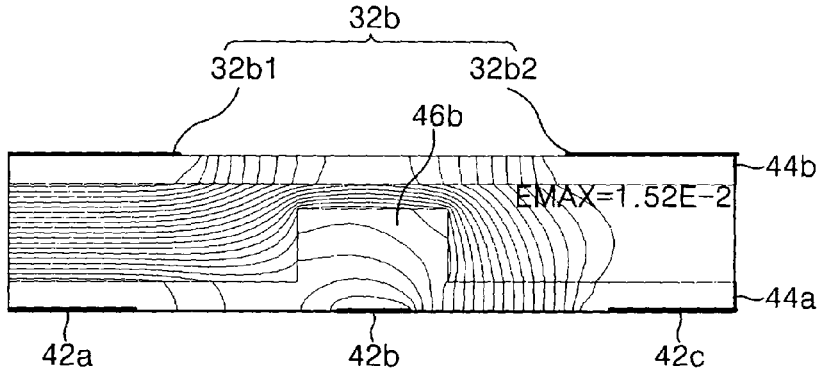
FIG.9 RELATED ART
Figure 10:
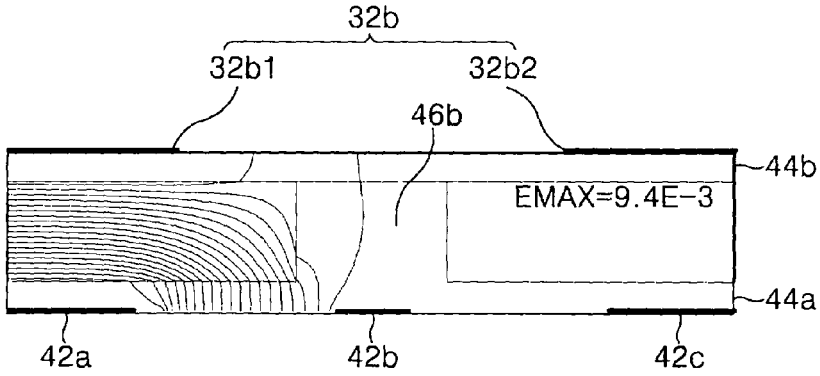
FIG.10 RELATED ART
Figure 11:
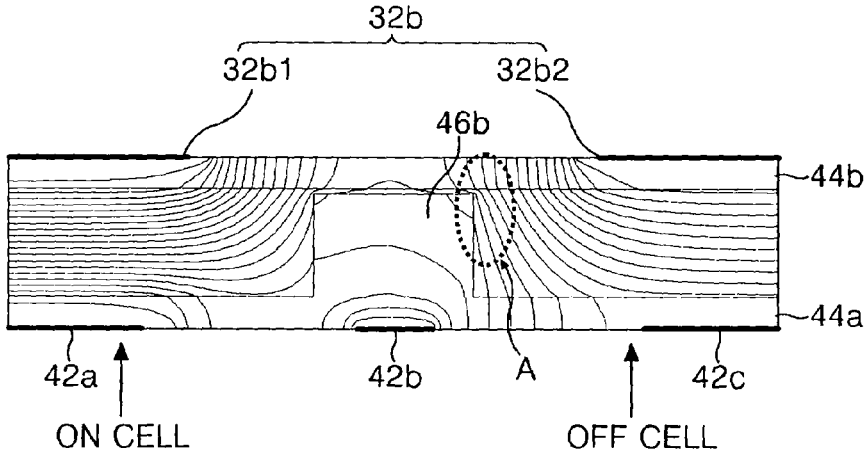
FIG.11 RELATED ART
Figure 12:
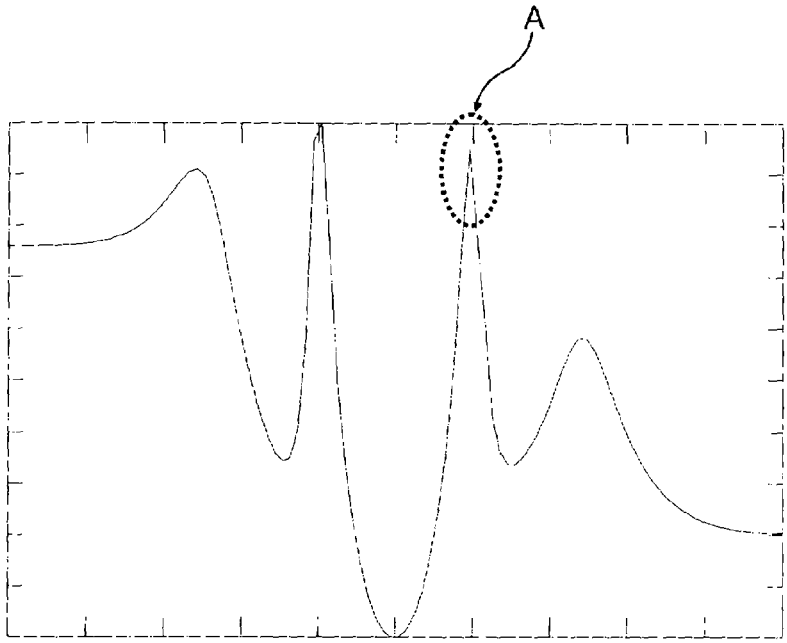
FIG.12 RELATED ART
FIG. 12 is a diagram representing a relative strength of an electric field formed within the right and left discharge cells when a data voltage is applied to an address electrode as in FIG. 11.
Figure 13:
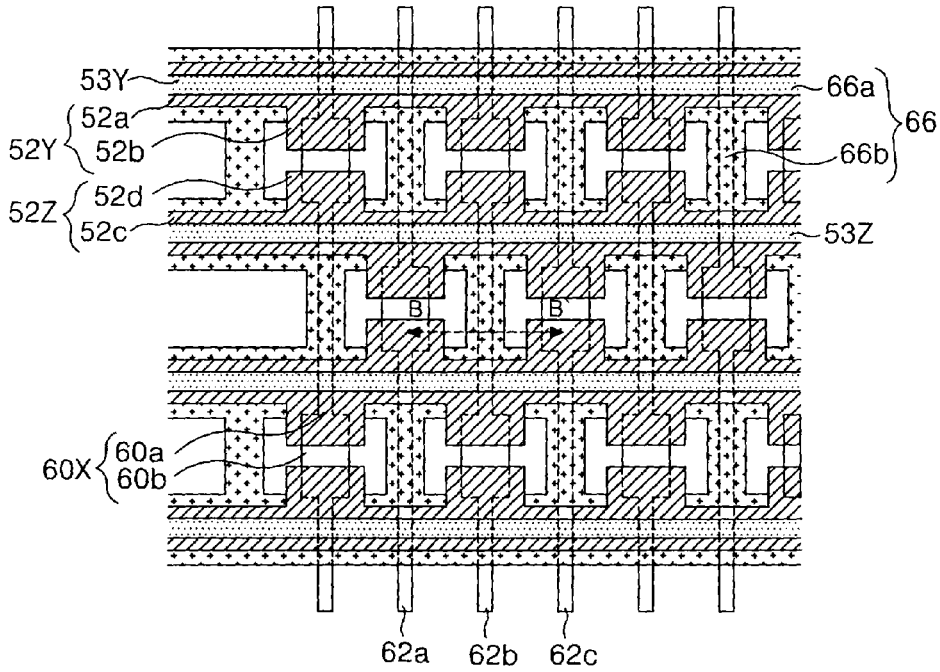
FIG. 13 is a plan view representing an electrode structure of a plasma display panel according to the present invention.

Referring to FIG. 13, a plasma display panel PDP according to an embodiment of the present invention has a delta type structure where discharge cells located adjacent to each other on the upward/downward each make up one pixel. In other words, in the PDP according to the embodiment of the present invention, an R sub-pixel and a B sub-pixel located in the $n^{th}$ (n is a natural number over 1) line and a G sub-pixel located in the $(n+1)^{th}$ or $(n-1)^{th}$ line make up one pixel.

The PDP according to the embodiment of the present invention includes an address electrode 60X on a lower plate, a first and a second electrode 52Y, 52Z formed on un upper plate crossing the address electrode 60X, and a first and a second bus electrode 53Y, 53Z formed on the first and second electrodes 52Y and 52Z.

The first and second electrodes 52Y, 52Z include a first and a second main electrode 52A, 52C formed in a perpendicular direction to the address electrode 60X, and a first and a second auxiliary electrode 52B, 52D extended from the first and second main electrodes 52A, 52C.

The first auxiliary electrode 52B is formed in turn or in a zigzag on both sides of the first main electrode 52A. In other words, if the first auxiliary electrode 62B crossing the $n^{th}$ address electrode 60X is extended from the first side of the first main electrode 62A, the first auxiliary electrode 52B crossing the $(n+1)^{th}$ address electrode 60X is extended from the second side of the first main electrode 52A.

The second auxiliary electrode 52D is formed in turn on the first and second sides of the second main electrode 52C in the same way as the first auxiliary electrode 52B. At this moment, the second main electrode 52C is formed opposite to the first main electrode 52A. In other words, if the first auxiliary electrode 52B crossing the $n^{th}$ address electrode 60X is extended from the first side of the first main electrode 52A, the second auxiliary electrode 52D crossing the $n^{th}$ address electrode 60X is extended from the second side of the second main electrode 52C.

The address electrode 60X includes an address main electrode 60A formed in a line crossing the first and second main electrodes 52A, 52C, and an address auxiliary electrode 60B extended by a designated width in a direction of crossing the address main electrode 60A within a discharge cell that makes up one pixel.

Further, on the upper surface of the PDP according to the first embodiment of the present invention, there are the second auxiliary electrodes 52B alternately extended from the first main electrode 52A, and a first dielectric layer 64B that the upper dielectric layer and the protective film are sequentially deposited on the entire upper plate to cover the second auxiliary electrode 52B.

The wall charges generated upon the plasma discharge are accumulated through the upper dielectric layer on the first dielectric layer 64B, which prevents the damage of itself caused by the sputtering generated upon the plasma discharge by way of the passivation film and at the same time increases the emission efficiency of the secondary electrons.

On the lower surface of the PDP, there are formed a first to a third address electrode 62A, 62B, 62C crossing the first and second electrodes 52Y and 52Z, a second dielectric layer 64A on the entire lower plate to cover the address electrodes 62A, 62B, 62C, and barrier ribs 66 to partition off discharge cells.

There is formed a phosphorus (not shown) on the surface of the second dielectric layer 64A and the horizontal barrier ribs 66B. The first and third address electrodes 62A, 62C formed on both sides among the first to third address electrodes 62A, 62B, 62C are the address auxiliary electrode 60B extended from the address main electrode 60A to the direction of the first and second electrodes 52Y, 52Z, and the second address electrode 62B is the address electrode main electrode 60A.

The barrier ribs 66 includes vertical barrier ribs 66A and horizontal barrier ribs 66B connected to the vertical barrier ribs 66A vertically. The vertical barrier ribs 66A are formed crossing the first to third address electrodes 62A, 62B and 62C, and the horizontal barrier ribs 66B are formed parallel to the first to third address electrodes 62A, 62B, 62C, with their upper end rounded. At this moment, the horizontal barrier ribs 66B is formed with their upper end rounded and their central area convex. Hereby, the edge of the horizontal barrier ribs 668 is lower than the central area of the horizontal barrier ribs 66B.

The upper end of the barrier ribs 66 is opposite to the upper plate having an air gap therebetween. Accordingly, the air gap between the upper end edge of the horizontal barrier ribs 66B and the upper plate is different from the air gap between the upper end central area of the horizontal barrier ribs 66B and the upper plate.

Figure 15:
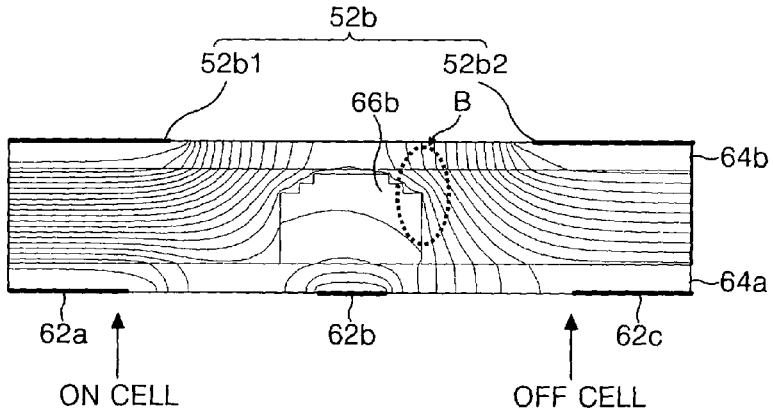
FIG. 15 is a sectional view of the plasma display panel according to the second embodiment of the present invention, taken along the line "B–B'" of FIG. 13.

On the other hand, on the upper surface of the PDP according to the second embodiment of the present invention, as shown in FIG. 15, there are the second auxiliary electrodes 52B alternately extended from the first main electrode 52A, and a first dielectric layer 64B that the upper dielectric layer and the protective film are sequentially deposited on the entire upper plate to cover the second auxiliary electrode 52B. The wall charges generated upon the plasma discharge are accumulated through the upper dielectric layer on the first dielectric layer 64B, which prevents the damage of itself caused by the sputtering generated upon the plasma discharge by way of the passivation film and at the same time increases the emission efficiency of the secondary electrons.

On the lower surface of the PDP, there are formed a first to a third address electrode 62A, 62B, 62C crossing the first and second electrodes 52Y and 52Z, a second dielectric layer 64A on the entire lower plate to cover the address electrodes 62A, 62B, 62C, and barrier ribs 66 to partition off discharge cells.

There is formed a phosphorus (not shown) on the surface of the second dielectric layer 64A and the horizontal barrier ribs 66B. The first and third address electrodes 62A, 62C formed on both sides among the first to third address electrodes 62A, 62B, 62C are the address auxiliary electrode 60B extended from the address main electrode 60A to the direction of the first and second electrodes 52Y, 52Z, and the second address electrode 62B is the address electrode main electrode 60A.

The barrier ribs 66 includes vertical barrier ribs 66A and horizontal barrier ribs 66B connected to the vertical barrier ribs 66A vertically. The vertical barrier ribs 66A are formed crossing the first to third address electrodes 62A, 62B and 62C, and the horizontal barrier ribs 66B are formed parallel to the first to third address electrodes 62A, 62B, 62C, with their upper end edge stepped or chamfered by the about 20 μm. At this moment, the horizontal barrier ribs 66B is formed with their upper end edge stepped. Such barrier ribs 66 prevent the ultraviolet ray and the visible ray generated by the discharge from leaking out to the adjacent discharge cells. At this moment, the area, which is needed to be stepped or chamfered, is the area of the barrier ribs where the barrier ribs is perpendicular to the address electrode. Owing to this, the edge of the horizontal barrier ribs 66B is lower than the central area of the horizontal barrier ribs 66B.

The upper end of the barrier ribs 66 is opposite to the upper plate having an air gap therebetween. Accordingly, the air gap between the upper end edge of the horizontal barrier ribs 66B and the upper plate is different from the air gap between the upper end central area of the horizontal barrier ribs 66B and the upper plate.

Figure 14:
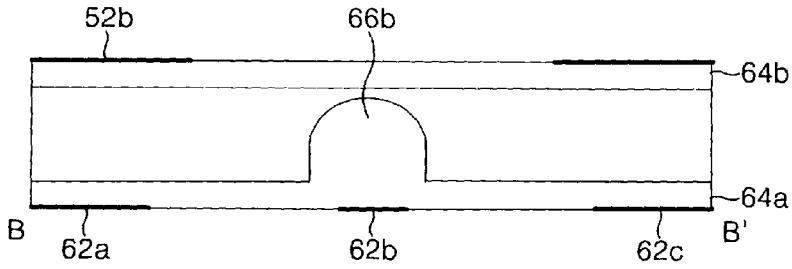
FIG. 14 is a sectional view of the plasma display panel according to the first embodiment of the present invention, taken along the line "B–B'" of FIG. 13.
Figure 16:
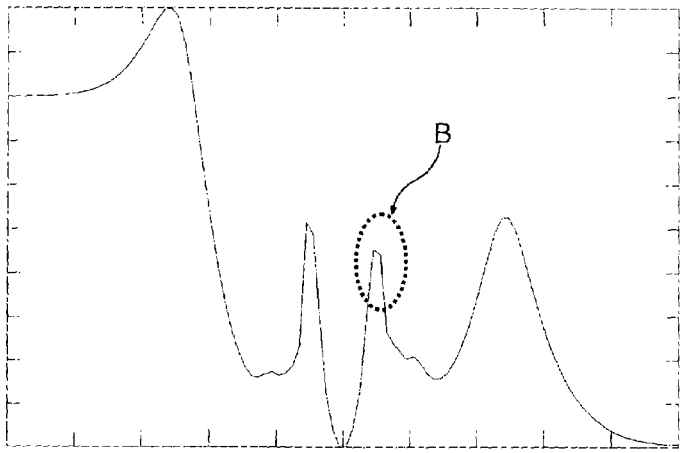
FIG. 16 is a diagram representing a relative strength of an electric field formed within the right and left discharge cells when a data voltage is applied to an address electrode as in FIG. 15.

FIG. 16 is a diagram representing a relative strength of an electric field formed within the right and left discharge cells when a data voltage is applied to an address electrode in the event that there is a barrier rib structure as in FIGS. 14 and 15.

Firstly, the width of the second auxiliary electrodes 52B formed on the upper plate of the PDP shown in FIGS. 14 and 15 is 185 μm, the width of the first and third address electrodes 62A, 62C formed on both sides of the lower plate is 150 μm. 70 μm is the width of the second address electrode 62B, which is formed between the first and third address electrodes 62A, 62C and where the address auxiliary electrode 60B is not formed. 120 μm is the height of the barrier ribs 66 formed being closed on the lower plate, and the dielectric constant of the barrier ribs 66 is 12. Further, 30 μm is the first and second dielectric layers 64 formed on each electrode of the upper plate and the lower plate. At this moment, the second auxiliary electrodes 52B consist of a first-second auxiliary electrode 52B1 formed on its left on the basis of the horizontal barrier ribs 66, and a second-second auxiliary electrode 52B2 formed on its right. The air gap between the horizontal barrier ribs 66B and the first dielectric layer 64B is about 5 μm.

Further, the first-second auxiliary electrode 52B1 and the second—second auxiliary electrode 52B2 are supplied with a voltage of −1.2, the third address electrode 62C is supplied with 0V, and the first and the second address electrodes 62B, 62C are supplied with a data voltage of 1V. In this case, the discharge cell including the first address electrode 62B is the cell turned on (hereinafter, on-cell), and the cell including the third address electrode 62C is the cell turned off (hereinafter, off-cell) because the data voltage is not applied.

In this case, the strength of the maximum electric field of the cell including the third address electrode 62C, i.e., the off-cell, is far less than the strength of the maximum electric field Emax of the cell including the first address electrode 62A, i.e., the on-cell, (reduced down to about ½). Hereby, the mis-discharge with the adjacent cell can be prevented. In other words, the upper end of the horizontal barrier ribs 66B are formed in a rounded shape or a stepped/chamfered shape, thus the strength of the maximum electric field of the on-cell is made weak to be able to weaken the electric field concentrated distribution.

Figure 17:
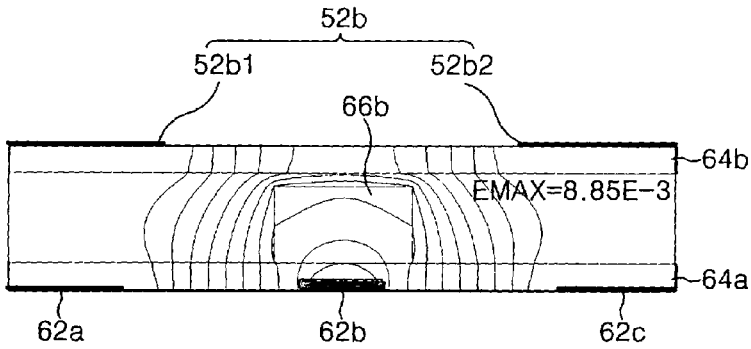
FIG. 17 is a sectional view of the plasma display panel according to the third embodiment of the present invention, taken along the line "B–B'" of FIG. 13.

On the other hand, on the upper surface of the PDP according to the third embodiment of the present invention, as shown in FIG. 17, there are the second auxiliary electrodes 52B alternately extended from the first main electrode 52A, and a first dielectric layer 64B that the upper dielectric layer and the protective film are sequentially deposited on the entire upper plate to cover the second auxiliary electrode 52B. The wall charges generated upon the plasma discharge are accumulated through the upper dielectric layer on the first dielectric layer 64B, which prevents the damage of itself caused by the sputtering generated upon the plasma discharge by way of the passivation film and at the same time increases the emission efficiency of the secondary electrons.

On the lower surface of the PDP, there are formed a first to a third address electrode 62A, 62B, 62C crossing the first and second electrodes 52Y and 52Z, a second dielectric layer 64A on the entire lower plate to cover the address electrodes 62A, 62B, 62C, and barrier ribs 66 to partition off discharge cells.

There is formed a phosphorus (not shown) on the surface of the second dielectric layer 64A and the horizontal barrier ribs 66B, The first and third address electrodes 62A, 62C formed on both sides among the first to third address electrodes 62A, 62B, 62C are the address auxiliary electrode 60B extended from the address main electrode 60A to the direction of the first and second electrodes 52Y, 52Z, and the second address electrode 62B is the address electrode main electrode 60A.

The barrier ribs 66 includes vertical barrier ribs 66A and horizontal barrier ribs 66B connected to the vertical barrier ribs 66A vertically. The vertical barrier ribs 66A are formed crossing the first to third address electrodes 62A, 62B and 62C, and the horizontal barrier ribs 66B are formed parallel to the first to third address electrodes 62A, 62B, 62C.

In the horizontal barrier ribs 66B in the present invention, the lower end thereof adjacent to the second address electrode 62B and the other area except for the lower end each have a different dielectric constant. In other words, the lower end of the horizontal barrier ribs 66B is made up of a material with a low dielectric constant as compared with the upper end thereof. In FIG. 17, the dielectric constant of the lower end of the horizontal barrier ribs 66B is 12 or less (e.g., the dielectric constant of air=1), and the dielectric constant of the area except for the lower end of the horizontal barrier ribs, i.e., the upper end, is 12 or more, At this moment, the dielectric constant of the horizontal barrier ribs 66B is lower than the dielectric constant of the vertical barrier ribs 66A, i.e., the dielectric constant of 12.

Accordingly, all the voltage applied to the second address electrode 62B is almost applied in the area that is made up of the material with the low dielectric constant. It is shown in black around the second address electrode 62B in FIG. 17. That is, it represents that equipotential surfaces are concentrated around the second address electrode 62B and that the strength of the electric field is strong around the second address electrode 62B. Hereby, as in FIG. 17, the strength of the maximum electric field (Emax=8.85E-3) is shown to be lower as compared with the other cases, and the probability of generating mis-discharge with the adjacent discharge cell becomes lessened.

Further, as explained in FIG. 17, the discharge, which might be generated due to the pulse applied to column electrode of the neighboring discharge cell, can be prevented even in the event that the air gap is made within the lower end of the horizontal barrier ribs 66B on the second address electrode 62B, thereby improving a picture quality.

Figure 18:
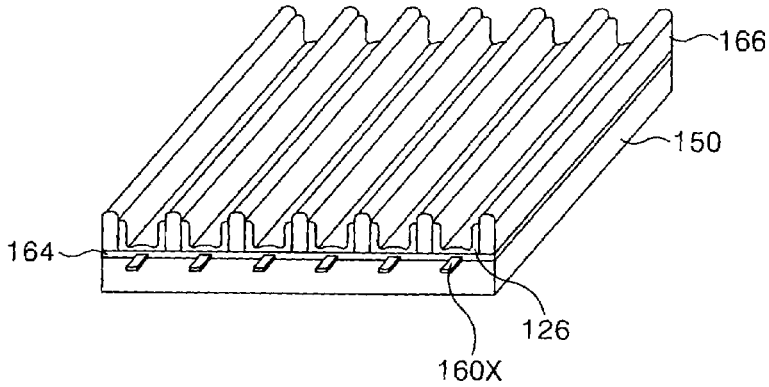
FIG. 18 is a perspective view representing a lower plate structure of a PDP that has barrier ribs of stripe type, according to the fourth embodiment of the present invention.

On the other hand, referring to FIG. 18, a PDP according to another embodiment of the present invention includes upper plate electrodes formed on an upper plate (not shown), an upper dielectric layer (not shown) formed on the upper plate to cover the upper plate electrodes, a passivation film (not shown) formed on the upper dielectric layer, address electrodes 160X formed on a lower plate 150 opposite to the upper plate with a discharge space therebetween crossing the upper plate electrodes, a lower dielectric layer 164 formed on the lower plate to cover the address electrodes 160X, barrier ribs 166 formed on and perpendicularly to the lower dielectric layer 164 to partition off discharge cells, and a phosphorus 126 formed on the lower dielectric layer 164 and the barrier ribs 166.

The upper electrodes include a pair of sustain electrodes (not shown) formed parallel to the each other on the upper plate. The upper dielectric layer has wall charges accumulated upon plasma discharge, and a passivation film prevents the damage of the sustain electrode pair and the upper dielectric layer caused by the sputtering of gas ion upon the plasma discharge, thus lengthening the life-time of the PDP and acting to increase the emission efficiency of the secondary electron.

The address electrode 160X of the lower plate 150 is formed crossing the sustain electrode pair. The address electrode 160X is supplied with data signals in order to select cells to be displayed.

The barrier ribs 166 is a stripe type and formed parallel to the address electrode 160X to prevent the ultraviolet ray generated by the discharge from leaking out to the adjacent discharge cells, thereby acting to prevent electrical optical crosstalk between the adjacent discharge cells.

Figure 19B:
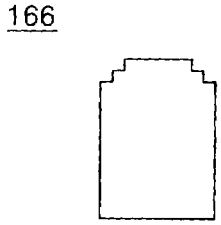
FIG. 19B is a sectional view representing barrier ribs of stripe type with their upper end stepped as shown in FIG. 18.
Figure 19A:
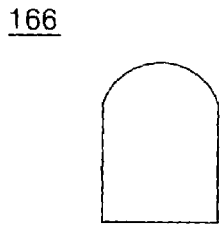
FIG. 19A is a sectional view representing barrier ribs of stripe type with their upper end round-shaped as shown in FIG. 18.

The barrier ribs 166 are formed to have their upper end rounded as shown in FIG. 19A. In other words, the barrier ribs 166 is formed to be round having their upper end central area convex. Due to this, the edge of the barrier ribs 166 is lower than the central area of the barrier ribs 166.

The upper end of the barrier ribs 166 is opposite to the upper plate having an air gap therebetween. Accordingly, the air gap between the upper end edge of the barrier ribs 166 and the upper plate is different from the air gap between the upper end central area of the barrier ribs 166 and the upper plate.

The surface of the lower dielectric layer 164 and the barrier ribs 166 is coated with a phosphorus 126 to generate any one of red, green and blue visible rays. And, there is injected an inert mixture gas such as He+Xe, Ne+Xe, He+Xe+Ne for discharge into a gas discharge space provided between the upper plate, the lower plate 150 and the barrier ribs 166.

On the other hand, in the PDP according to the embodiment of the present invention, the barrier ribs 166, as shown in FIG. 19B, have the peripheral area around the edge of the upper end formed to be stepped or chamfered by the about 20 μm. In other words, the barrier ribs 166 have their upper end edge stepped. Such barrier ribs 166 prevent the ultraviolet ray and the visible ray generated by the discharge from leaking out to the adjacent discharge cells. At this moment, the area, which is needed to be stepped or chamfered, is the area of the barrier ribs perpendicular to the address electrode. Because of this, the edge of the barrier ribs 166 is lower than the central are of the barrier ribs 166. The upper end of the barrier ribs 166 is opposite to the upper plate having the air gap therebetween. Accordingly, the air gap between the upper end edge of the barrier ribs 166 and the upper plate is different from the air gap between the upper end central area of the barrier ribs 166 and the upper plate.

In this case, in the PDP according to the embodiment of the present invention, the upper end of the barrier ribs 166 is formed to be rounded or stepped/chamfered, thus the strength of the maximum electric field of the off-cell is far less than the strength of the maximum electric field Emax of the on-cell (reduced down to about ½). Hereby, the mis-discharge with the adjacent cell can be prevented. In other words, the upper end of the barrier ribs 166 are formed in a rounded shape or a stepped/chamfered shape, thus the strength of the maximum electric field of the on-cell is made weak to be able to weaken the electric field concentrated distribution.

On the other hand, in the PDP according to the embodiment of the present invention, the lower end of the barrier ribs 166 and the other area except for the lower end of the barrier ribs 166 each is formed to have a different dielectric constant. In other words, the lower end of the barrier ribs 166 is made up of a material with a low dielectric constant as compared with the upper end thereof. Because of this, the dielectric constant of the lower end of the barrier ribs 166 is 12 or less (e.g., the dielectric constant of air=1), and the dielectric constant of the area except for the lower end of the barrier ribs 166, i.e., the upper end, is 12 or more.

Accordingly, all the voltage applied to the address electrode is almost applied in the area that is made up of the material with the low dielectric constant. Because of this, it represents that equipotential surfaces are concentrated around the address electrode and that the strength of the electric field is strong around the address electrode. Accordingly, the probability of generating mis-discharge with the adjacent discharge cell becomes lessened.

Figure 19C:
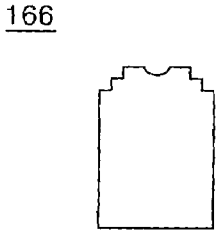
FIG. 19C is a sectional view representing barrier ribs of stripe type with their upper end grooved as shown in FIG. 18.

On the other hand, in the PDP according to the embodiment of the present invention, the barrier ribs 166 have a concave groove at their upper end as shown in FIG. 19C. Such barrier ribs 166 prevent the ultraviolet ray and the visible ray generated by the discharge from leaking out to the adjacent cells, and increase its exhaustion rate. Due to this, the edge of the barrier ribs 166 is lower than the central area of the barrier ribs 166. The upper end of the barrier ribs 166 is opposite to the upper plate with the air gap therebetween. Accordingly, the air gap between the upper end edge of the barrier ribs 166 and the upper plate becomes different from the air gap between the upper end central area of the barrier ribs 166 and the upper plate.

As described above, the plasma display panel according to the present invention has the upper end of the horizontal barrier ribs rounded or chamfered to prevent mis-discharge between the adjacent cells.

Further, the plasma display panel according to the present invention has the lower end of the horizontal barrier ribs near to the address electrode made up of a material with a low dielectric constant to prevent the crosstalk between the adjacent cells and to improve the picture quality.

Further, the plasma display panel according to the present invention has the air gap formed inside the lower part of the horizontal barrier ribs to prevent the mis-discharge, which is generated by the pulse applied to the electrode of the neighboring off-cell, and to improve the picture quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel having a barrier rib of predetermined cross section for partitioning off discharge cells, wherein an edge part of the predetermined cross section of the barrier ribs is lower than a top central part of the barrier ribs.

2. The plasma display panel according to claim 1, wherein the discharge cells include red, green and blue discharge cells, being arranged in a delta shape.

3. The plasma display panel according to claim 1, wherein the barrier rib includes:

a first barrier rib; and a second barrier rib coupled with the first barrier rib vertically.

4. The plasma display panel of claim 1, wherein at least parts of the upper end of the predetermined cross section of the barrier rib are rounded.

5. The plasma display panel according to claim 1, wherein at least parts of the upper end of the predetermined cross section of the barrier rib are stepped.

6. The plasma display panel of claim 1, wherein at least parts of the predetermined cross section of the barrier rib have a concave upper edge.

7. The plasma display panel according to claim 1, further comprising:

a plurality of first electrodes formed on a first substrate;

a plurality of second electrodes formed on a second substrate opposite to the first substrate with a discharge space therebetween to cross the first electrodes;

a first dielectric layer formed on the first substrate to cover the first electrodes;

a passivation film formed on the first dielectric layer;

a second dielectric layer formed on the second substrate to cover the second electrodes; and a phosphor formed on the second dielectric layer and the barrier ribs.

8. The plasma display panel according to claim 7, wherein the first electrode includes:

a metal bus electrode; and a transparent electrode connected to the metal bus electrode and having its width wider than the metal bus electrode.

9. The plasma display panel according to claim 8, wherein the transparent electrode includes:

a main electrode; and an auxiliary electrode extended from the main electrode toward the discharge cell, and wherein the auxiliary electrode is extended from both sides of the main electrode in a zigzag.

10. The plasma display panel according to claim 7, wherein the second electrode includes:

a main electrode; and an auxiliary electrode extended from both sides of the main electrode and having at least part thereof overlap the first electrode.

11. The plasma display panel according to claim 1, wherein the barrier rib of predetermined cross section is formed in a striped shape, and central parts of the predetermined cross section of the barrier ribs are convex.

12. The plasma display panel of claim 1, wherein the barrier rib is formed in a striped shape, and edge parts of predetennined cross section of the barrier are stepped.

13. A plasma display panel having barrier ribs for partitioning off discharge cells, wherein different parts of the barrier ribs are made of materials having different dielectric constants.

14. The plasma display panel according to claim 13, wherein edge parts of the barrier ribs of predetermined cross section are lower than central parts of the predetermined cross section of the barrier ribs.

15. The plasma display panel according to claim 13, wherein the barrier ribs include:

first barrier ribs; and second barrier ribs coupled with the first barrier ribs vertically.

16. The plasma display panel according to claim 15, wherein any one of the first and second barrier ribs has a lower part made of a material having a dielectric constant less than the dielectric constant of the material that makes up its upper part.

17. The plasma display panel according to claim 16, wherein the dielectric constant value of the lower part material of any one of the first and second barrier ribs is less than 12, and a dielectric constant value of the material of an area except for the lower part is 12 or more.

18. A plasma display panel having a barrier rib for partitioning off discharge cells, wherein an upper end of the barrier rib is opposite to a substrate with an air gap therebetween, and the air gap between an end edge of the barrier rib and the substrate is different from the air gap between a central part of the barrier rib and the substrate.

19. The plasma display panel according to claim 18, wherein different parts of the barrier rib are made of materials having different dielectric constants.

20. The plasma display panel according to claim 18, wherein the edge part of the cross sectional shape of the barrier rib is lower than central part of the cross sectional shape of the barrier rib.

21. A plasma display panel having a barrier rib of predetermined cross sectional shape for partitioning off discharge cells, wherein an upper end of the barrier rib is opposite to a substrate with an air gap therebetween, different parts of the barrier rib are made of materials having different dielectric constant values, and an edge part of the cross sectional shape of the barrier rib is lower than a central part of the cross sectional shape of the barrier rib.

* * * * *